US012305465B2

(12) United States Patent
Hebert

(10) Patent No.: US 12,305,465 B2
(45) Date of Patent: May 20, 2025

(54) NESTED TUBING HANGER

(71) Applicant: Dril-Quip, Inc., Houston, TX (US)

(72) Inventor: Christopher William Hebert, Edmonton (CA)

(73) Assignee: Innovex International, Inc., Houston, TX (US)

( * ) Notice: Subject to any disclaimer, the term of this patent is extended or adjusted under 35 U.S.C. 154(b) by 0 days.

(21) Appl. No.: 18/535,870

(22) Filed: Dec. 11, 2023

(65) Prior Publication Data

US 2024/0191588 A1 Jun. 13, 2024

Related U.S. Application Data

(60) Provisional application No. 63/432,331, filed on Dec. 13, 2022.

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/043
See application file for complete search history.

(56) References Cited

U.S. PATENT DOCUMENTS 4,291,768 A * 9/1981 Diehl ..... F16J 15/185 166/88.4
2005/0284640 A1* 12/2005 Borak ..... E21B 33/04 166/75.13
2006/0060349 A1* 3/2006 Duhn ..... E21B 33/03 166/88.1
2010/0243238 A1 9/2010 Gette et al.
2011/0005774 A1 1/2011 Sinnott et al.
2011/0030974 A1 2/2011 Nguyen
2012/0097399 A1* 4/2012 Kobata ..... E21B 23/01 166/368
2012/0305269 A1 12/2012 Bories et al.
2017/0254166 A1* 9/2017 Berryhill ..... E21B 33/035
2023/0340852 A1* 10/2023 Emmett ..... E21B 33/04

FOREIGN PATENT DOCUMENTS

WO 2017076978 A1 5/2017

OTHER PUBLICATIONS

Notification of transmittal of the international search report and the written opinion of the international searching authority, or the declaration, PCT/US2023/083419, mailed Apr. 8, 2024, 11 pages.

* cited by examiner

*Primary Examiner* — Nicole Coy
*Assistant Examiner* — Nicholas D Wlodarski
(74) *Attorney, Agent, or Firm* — Baker Botts L.L.P.

(57) ABSTRACT

A nested tubing hanger has a wellhead housing that defines a wellhead bore, an outer hanger installed within the wellhead bore of the wellhead housing that has a parent bowl that supports an inner hanger. A hanger engagement carried by the outer hanger is radially moveable between a release position and an engagement position. In the engagement position, the hanger engagement engages an engagement profile on an outer surface of the inner hanger to lock the inner hanger in the outer hanger. With the hanger engagement in a release position, the inner hanger is removable from the outer hanger.

17 Claims, 5 Drawing Sheets

NESTED TUBING HANGER

CROSS-REFERENCE TO RELATED APPLICATIONS

The present application claims priority to U.S. Provisional Patent Application No. 63/432,331, filed on Dec. 13, 2022, the content of which is hereby incorporated by reference in its entirety.

TECHNICAL FIELD

This relates to a nested tubing hanger, and in particular, a locking mechanism for the nested inner hanger.

BACKGROUND

In oil and gas wells, wellhead assemblies typically include a tubing hanger to support tubing strings. The size of the tubing hanger may be reduced by installing a nested hanger within the tubing hanger. This typically involves installing a parent bowl in the wellhead assembly, into which a smaller hanger is landed or "nested".

SUMMARY

According to an aspect, there is provided a nested tubing hanger, comprising a wellhead housing defining a wellhead bore, an outer hanger installed within the wellhead bore of the wellhead housing and having an inner surface that define a parent bowl, and an inner hanger supported by the parent bowl. The outer hanger comprises a hanger engagement that is radially moveable between a release position and an engagement position relative to the inner surface. The inner hanger has an inner surface that defines an inner tubing bowl, and an engagement profile on an outer surface of the inner hanger. With the hanger engagement in the engagement position, the inner hanger is locked within the outer hanger, and with the hanger engagement in the release position, the inner hanger is removable from the outer hanger. An actuator is moveable between an unactuated position and an actuated position. As the actuator moves from the unactuated position to the actuated position, the actuator actuates the hanger engagement to move from the release position to the engagement position.

According to other aspects, the nested tubing hanger may comprise one or more of the following features, alone or in combination: the actuator may comprise an actuator ring adjacent to the hanger engagement, the actuator ring being axially moveable between the unactuated position and the actuated position, the actuator ring having an actuation surface that cooperates with the hanger engagement to convert axial movement of the actuator ring to radial movement of the hanger engagement; the wellhead housing may comprise threaded pins that extend radially outward from the wellhead bore, the threaded pins engaging an outer sloped surface of the actuator ring such that inward radial movement of the threaded pins causes the actuator ring to shift axially toward the actuated position; the actuator ring may be carried on an external surface of the outer hanger; the actuator ring may comprise a lock that selectively locks the actuator ring in the actuated position separately from the wellhead housing; the lock may comprise pin connectors that are insertable through apertures in the actuator ring; the hanger engagement may comprise locking ring segments carried on the inner surface of the outer hanger and energizing pins that extend from an outer surface of the outer hanger, the energizing pins being engaged by the actuator; the wellhead housing may comprise a support shoulder that extends into wellhead bore, the outer hanger being supported within the wellhead bore by the support shoulder; and the support shoulder may be selectively removable from the wellhead bore.

According to an aspect, there is provided a method of installing a tubing hanger in a wellhead, comprising: inserting an outer hanger into an inner bore of a wellhead housing such that the outer hanger is supported by a support shoulder of the wellhead housing, the outer hanger having an inner surface that defines a parent bowl, the outer hanger comprising a hanger engagement that is radially moveable between a release position and an engagement position; inserting an inner hanger into the outer hanger such that the inner hanger engages the parent bowl of the outer hanger, the inner hanger comprising an inner surface that defines an inner tubing bowl, and an engagement profile on an outer surface of the inner hanger; and actuating the hanger engagement from the release position to the engagement position such that the hanger engagement engages the engagement profile to secure the inner hanger within the outer hanger.

According to an aspect, the method may comprise one or more of the following aspects alone or in combination: actuating the hanger engagement may comprise moving an actuator ring axially relative to the hanger engagement from an unactuated position to an actuated position, the actuator ring having an actuation surface that cooperates with the hanger engagement to convert axial movement of the actuator ring to radial movement of the hanger engagement; the wellhead housing may comprise threaded pins that extend radially outward from the wellhead bore, and wherein actuating the actuator ring comprises threading the threaded pins into engagement with the actuator ring, the threaded pins engaging an outer sloped surface of the actuator ring to cause the actuator ring to shift axially toward the actuated position; the hanger engagement may be actuated to the engagement position to secure the inner hanger within the outer hanger prior to inserting the outer hanger into the inner bore of the wellhead housing; the inner hanger may be secured within the outer hanger by locking an actuator ring in the actuated position; the actuator ring may be locked in the actuated position by inserting pin connectors through apertures in the actuator ring; the hanger engagement may comprise locking ring segments carried on the inner surface of the outer hanger and energizing pins that extend from an outer surface of the outer hanger, the energizing pins being engaged by the actuator, and wherein actuating the hanger engagement comprises applying a force to the energizing pins; the method may comprise the steps of removing the outer hanger and the inner hanger from the wellhead housing, and removing the support shoulder of the wellhead housing.

According to other aspects, the nested tubing hanger and the method may include other aspects apparent from drawings and the description below.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 1:
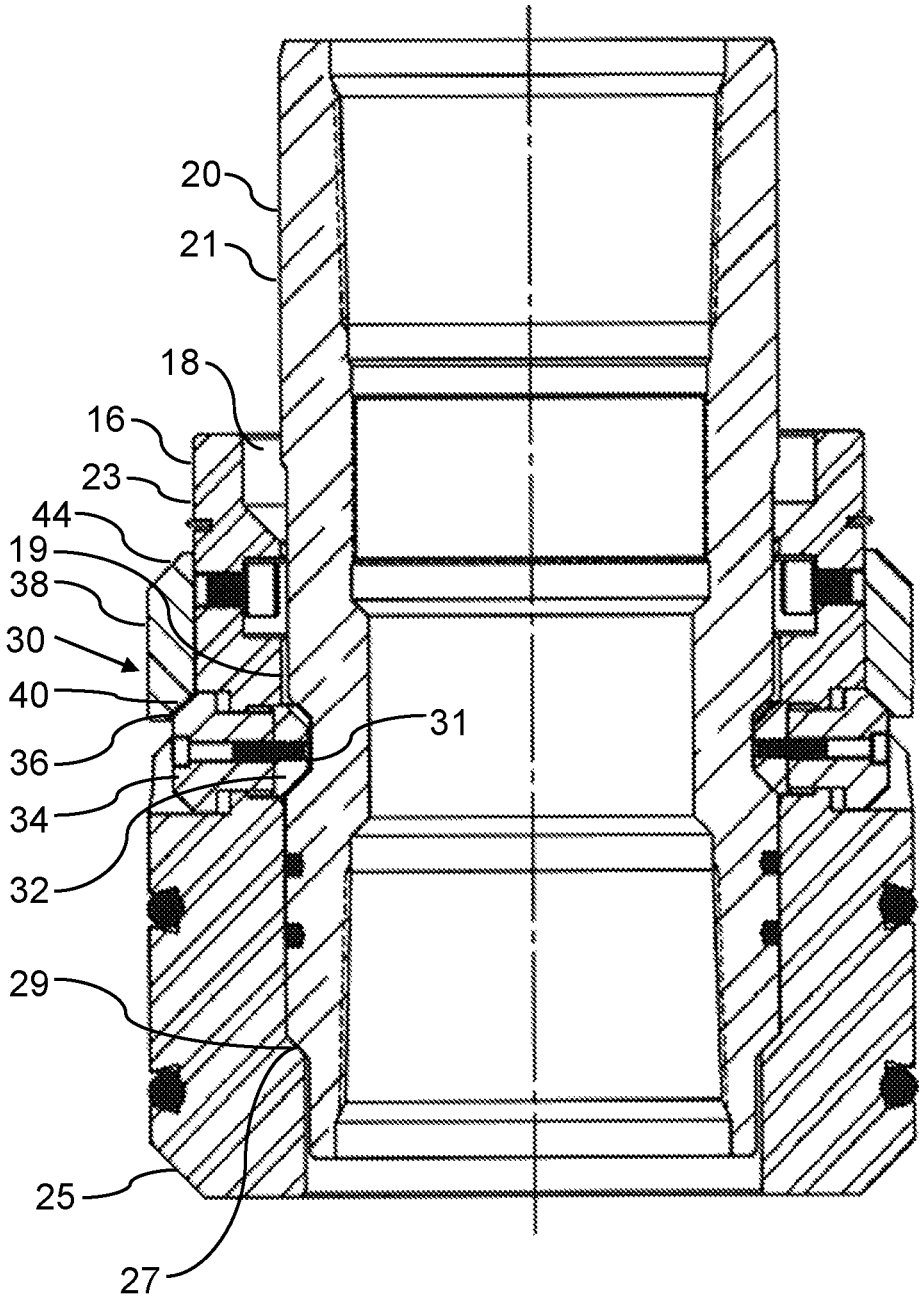
FIG. 1 is a side elevation view in section of an inner hanger installed in an outer hanger.

A nested tubing hanger, generally identified by reference numeral 10, will now be described with reference to FIG. 1 through 7.

Figure 5:
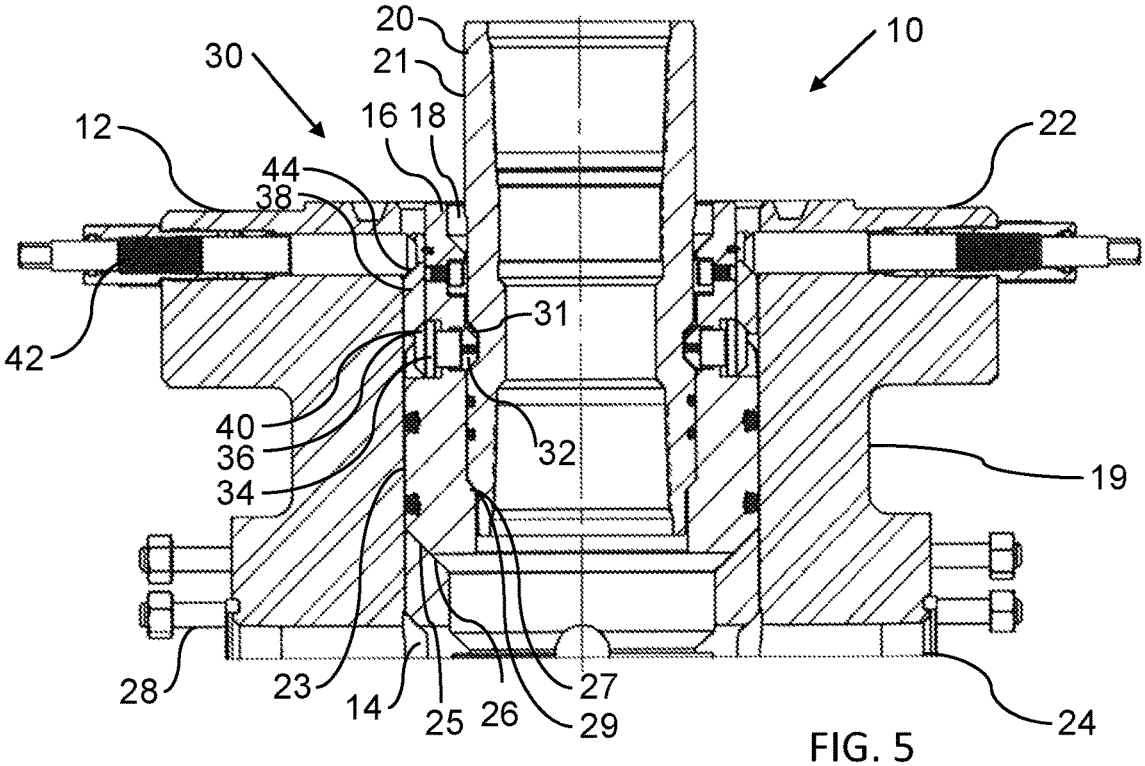
FIG. 5 is a side elevation view in section of the wellhead housing with the engagement in an engaged position.

Referring to FIG. 5, nested tubing hanger 10 has a wellhead housing 12 that defines a wellhead bore 14, an outer hanger 16 sized to be installed within wellhead bore 14, and an inner hanger 20 sized to be installed within the inner bore 18 of outer hanger 16.

Figure 3:
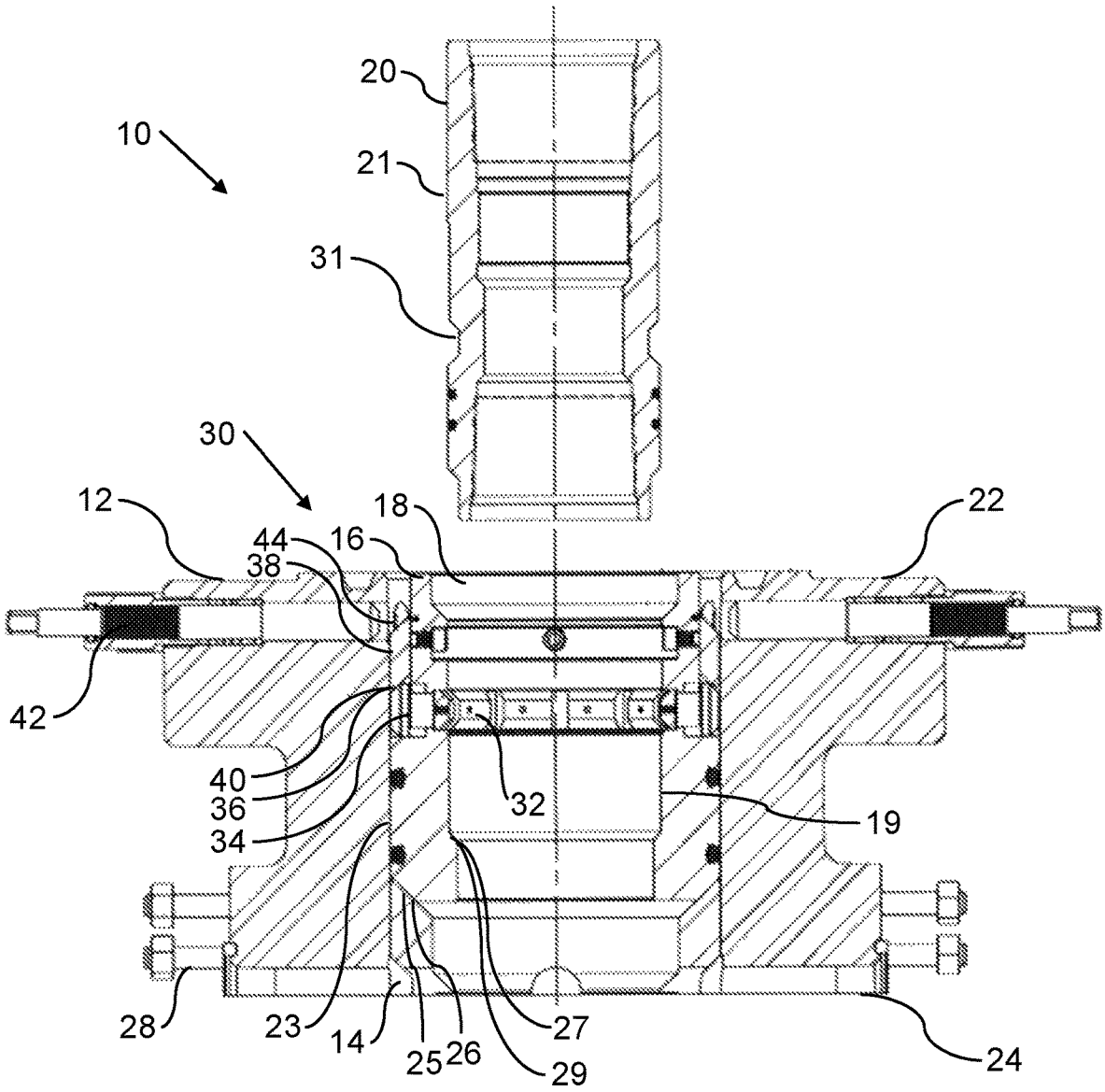
FIG. 3 is a side elevation view in section of an inner hanger being inserted into an outer hanger and wellhead housing.

Wellhead housing 12 may be a spool with upper and lower connection flanges 22 and 24 to allow it to be connected as part of a typical wellhead assembly. Wellhead housing 12 may have a support shoulder 26 that extends into inner bore 14 and defines a narrowed diameter. Referring to FIG. 3, outer hanger 16 may be lowered into inner bore 14 of wellhead housing 12 until a shoulder 25 carried by outer hanger 16 engages support shoulder 26 of wellhead housing 12 to support outer hanger 16 within wellhead housing 12. Support shoulder 26 may be removably secured within wellhead housing 12 using bolts 28 or other attachment. By making support shoulder 26 removable, wellhead housing 12 may provide full-bore access with outer hanger 16 and support shoulder 26 removed. Other designs of wellhead housing 12 may be used that support outer hanger 16.

Figure 2:
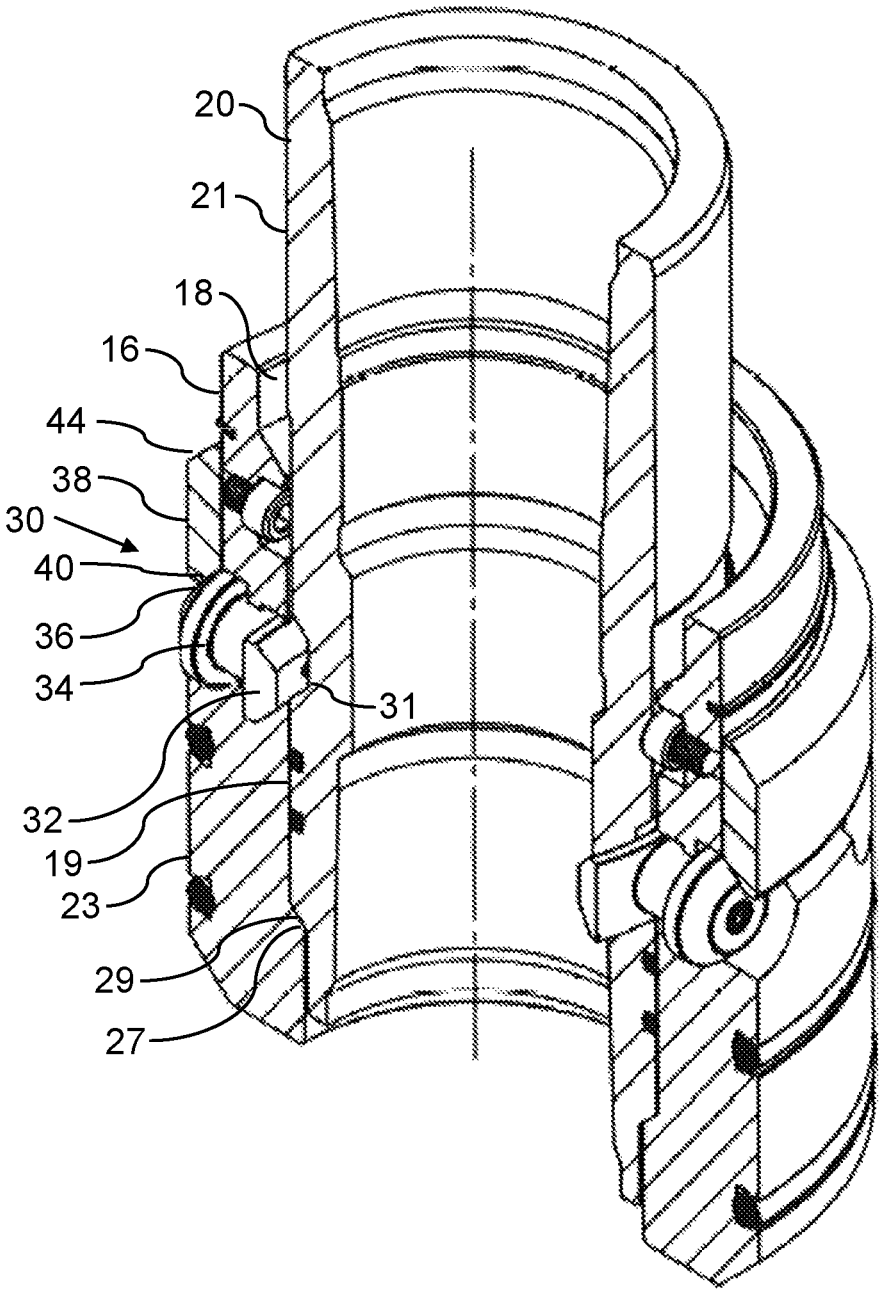
FIG. 2 is a perspective view in section of the inner hanger and outer hanger.
Figure 4:
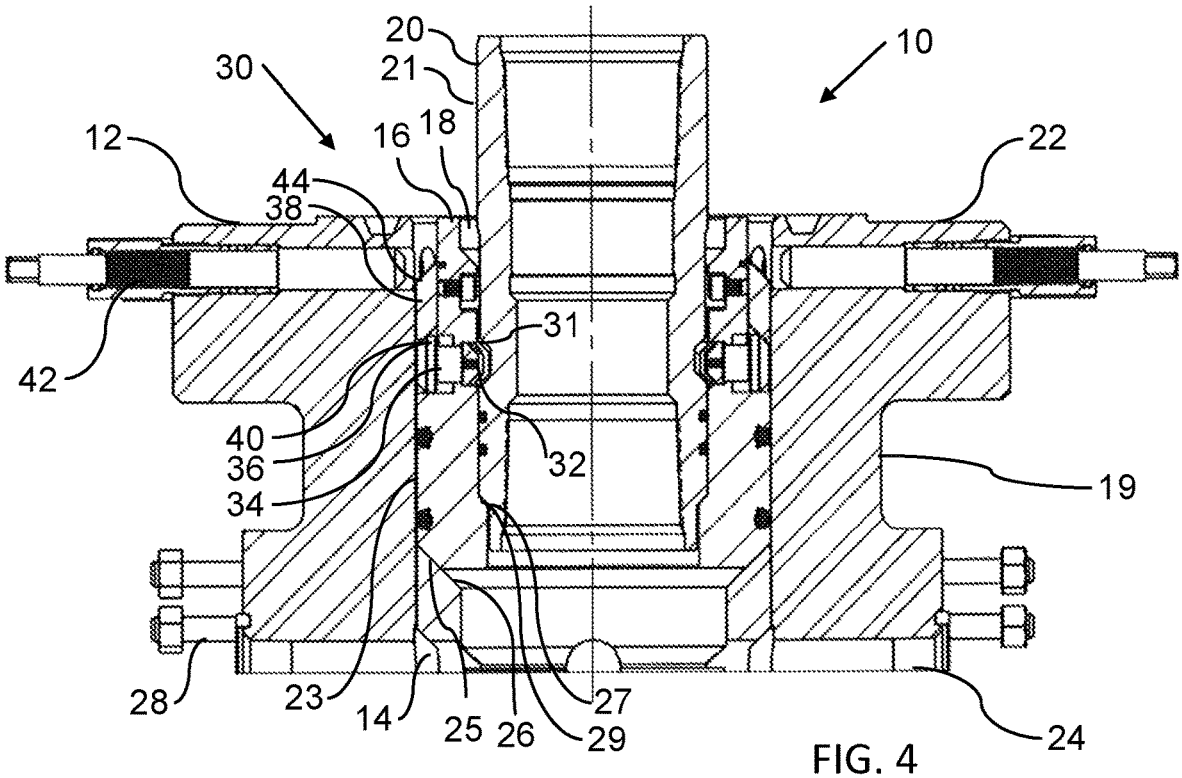
FIG. 4 is a side elevation view in section of the wellhead housing with the engagement in a disengaged position.

Referring to FIG. 1, inner hanger 20 has a lower shoulder 27 that engages and is supported by a parent bowl 29 on the inner surface of outer hanger 16, and then secured by a hanger engagement 30 that moves radially from a release position, shown in FIG. 4, to an engagement position, shown in FIGS. 1 and 5. Referring to FIG. 4, in the release position, hanger engagement 30 is withdrawn from inner bore 18. Inner bore 18 is defined by an inner surface 19, and inner bore 18 may have an inner diameter that varies along the height of outer hanger 16, at least with respect to a parent bowl 29 that is defined by a smaller inner diameter. In this case, hanger engagement 30 may be considered withdrawn provided that it does not obstruct inner hanger 20 from being lowered into engagement with parent bowl 29. Referring to FIG. 1, in the engagement position, hanger engagement 30 secures inner hanger 20 relative to outer hanger 16 by engaging a profile 31 on the outer surface 21 of inner hanger 20. Referring to FIG. 2, hanger engagement 30 may include ring segments 32 carried on the inner surface of outer hanger 16 and energizing pins 34 that extend through the sidewall of outer hanger 16. Referring to FIG. 3, energizing pins 34 may have sloped engagement ends 36 and are actuated by an actuator ring 38, which has a corresponding inner sloped surface 40 that engages the sloped engagement end 36 of energizing pins 34. Sloped surface 40 and sloped engagement end 36 may be defined, for example, by a tapered or radiused surface, in a manner that permits axial movement of actuator ring 38 to be translated into radial movement of energizing pins 34. As shown, in the withdrawn position, ring segments 32 are substantially flush with the adjacent portions of inner surface 19. Actuator ring 38 may be actuated by actuator, such as threaded pins 42, that extend through wellhead housing 12 and move radially to apply a force on actuator ring 38. The force applied by threaded pins 42 on actuator ring 38 causes it to move axially along the outer surface 23 of outer hanger 16 to engage and actuate energizing pins 34 to move them radially inward to apply an actuating force to locking ring segments 32, which are moved inward to engage profile 31 of inner hanger 20. As shown, threaded pins 42 extend radially, and engage an upper sloped surface 44 that converts the radial force into an axial force to move actuator ring 38 downward and engage energizing pins 34 as described above. It will be understood that threaded pins 42 may be positioned at other angles, and that actuator ring 38 may move upward or downward along the outer surface 23 of outer hanger 16. Threaded pins 42 may be replaced with other pin-type actuators that move radially.

Figure 6:
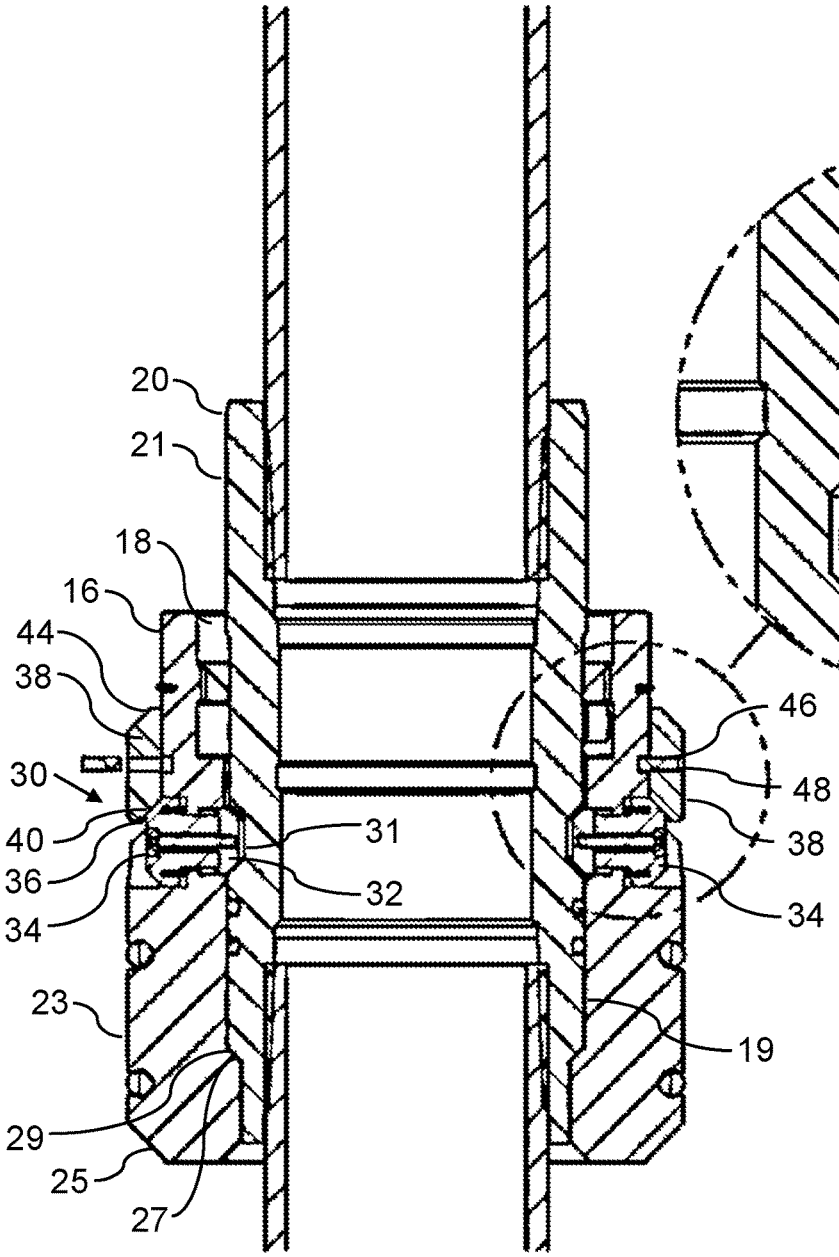
FIG. 6 is a side elevation view in section of an alternative wellhead housing.
Figure 7:
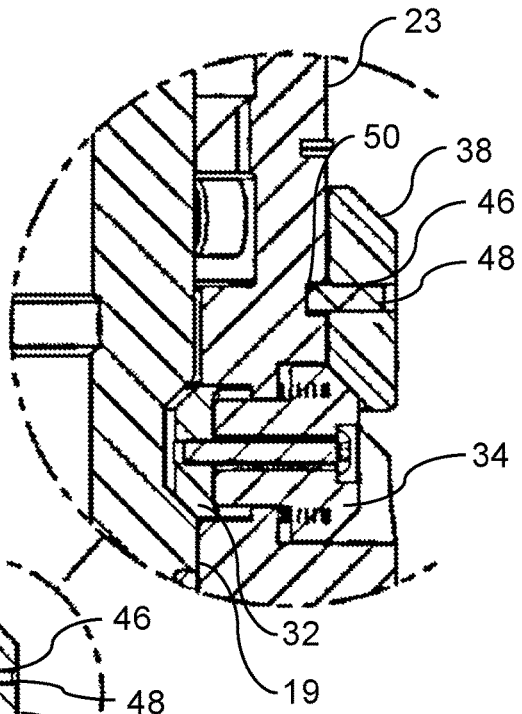
FIG. 7 is a detailed side elevation view in section of an engagement between the inner hanger and the outer hanger.

The examples above are described in terms of outer hanger 16 being installed in wellhead housing 12 and inner hanger 20 being run into outer hanger 16 thereafter. Referring to FIGS. 6 and 7, outer hanger 16 and inner hanger 20 may be designed to be mounted together so that they may be run in to wellhead housing 12 together. Actuator ring 38 may have apertures 46 that are sized to receive pin connectors 48, such as set screws or dowels, which may engage a corresponding détente or groove 50 in outer surface 23 of outer hanger 16. In this manner, actuator ring 38 may be secured in the lowered, actuated position to secure hanger engagement 30 in engagement with profile 31 on inner hanger 20. This may be used to run outer hanger 16 and inner hanger 20 into wellhead housing 12 as a single unit, rather than run inner hanger 20 separately from outer hanger 16.

In one method of use, referring to FIG. 3 and with outer hanger 16 installed in wellhead housing 12, inner hanger 20 may be lowered into outer hanger 16 until inner hanger 20 is received by parent bowl 29 of outer hanger 16, as shown in FIG. 4. Once inner hanger 20 is properly seated within outer hanger 16, hanger engagement 30 is actuated by causing threaded pins 42 to move radially toward wellhead bore 14 and engage actuator ring 38. Actuator ring 38 then moves axially along the outer surface 23 of outer hanger 16 such that sloped engagement end 36 and inner sloped surface 40 are engaged and push energizing pins 34 inward. As energizing pins 34 are pushed inward, ring segments 32 are pushed into engagement with profile 31 on the outer surface 21 of inner hanger 20 such that inner hanger 20 is locked in position relative to outer hanger 16, as shown in FIG. 5. Inner hanger 20 may be released by retracting threaded pins 42, which allows actuator ring 38, energizing pins 34, and ring segments 32 to move and release inner hanger 20 from outer hanger 16.

In another method of use, referring to FIG. 6, inner hanger 20 may be engaged with outer hanger 16 by locking actuator ring 38 in a lowered position using pin engagements 48 such that energizing pins 34 are pushed inward and into engagement with profile 31. The assembled outer and inner hangers 16 and 20 as shown in FIG. 6 may then be lowered into wellhead housing 12 and into engagement with support shoulder 26, as shown in FIG. 4, and locked in place by actuating threaded pins 42 as shown in FIG. 5.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A nested tubing hanger, comprising:

a wellhead housing defining a wellhead bore;

an outer hanger installed within the wellhead bore of the wellhead housing, the outer hanger having an inner surface that defines a parent bowl, the outer hanger comprising a hanger engagement that is radially moveable between a release position and an engagement position relative to the inner surface;

an actuator that is moveable between an unactuated position and an actuated position, wherein, as the actuator moves from the unactuated position to the actuated position, the actuator actuates the hanger engagement to move from the release position to the engagement position; and an inner hanger supported by the parent bowl of the outer hanger, the inner hanger having an inner surface that defines an inner tubing bowl, and an engagement profile on an outer surface of the inner hanger, wherein, with the hanger engagement in the engagement position, the inner hanger is locked within the outer hanger, and with the hanger engagement in the release position, the inner hanger is removeable from the outer hanger.

2. The nested tubing hanger of claim 1, wherein the actuator comprises an actuator ring adjacent to the hanger engagement, the actuator ring being axially moveable between the unactuated position and the actuated position, the actuator ring having an actuation surface that cooperates with the hanger engagement to convert axial movement of the actuator ring to radial movement of the hanger engagement.

3. The nested tubing hanger of claim 2, wherein the wellhead housing comprises threaded pins that extend radially outward from the wellhead bore, the threaded pins engaging an outer sloped surface of the actuator ring such that inward radial movement of the threaded pins causes the actuator ring to shift axially toward the actuated position.

4. The nested tubing hanger of claim 3, wherein the actuator ring is carried on an external surface of the outer hanger.

5. The nested tubing hanger of claim 3, wherein the actuator ring comprises a lock that selectively locks the actuator ring in the actuated position separately from the wellhead housing.

6. The nested tubing hanger of claim 5, wherein the lock comprises pin connectors that are insertable through apertures in the actuator ring.

7. The nested tubing hanger of claim 1, wherein the hanger engagement comprises locking ring segments carried on the inner surface of the outer hanger and energizing pins that extend from an outer surface of the outer hanger, the energizing pins being engaged by the actuator.

8. The nested tubing hanger of claim 1, wherein the wellhead housing comprises a support shoulder that extends into wellhead bore, the outer hanger being supported within the wellhead bore by the support shoulder.

9. The nested tubing hanger of claim 8, wherein the support shoulder is selectively removeable from the wellhead bore.

10. A method of installing a tubing hanger in a wellhead, comprising:

inserting an outer hanger into a wellhead bore of a wellhead housing such that the outer hanger is supported by a support shoulder of the wellhead housing, the outer hanger having an inner surface that defines a parent bowl, the outer hanger comprising a hanger engagement that is radially moveable between a release position and an engagement position relative to the inner surface;

inserting an inner hanger into the outer hanger such that the inner hanger engages the parent bowl of the outer hanger, the inner hanger comprising an inner surface that defines an inner tubing bowl, and an engagement profile on an outer surface of the inner hanger; and actuating, using an actuator, the hanger engagement to move from the release position to the engagement position such that the hanger engagement engages the engagement profile to secure the inner hanger within the outer hanger, when the actuator is moved from an unactuated position into an actuated position; and actuating, using the actuator, the hanger engagement to move from the engagement position to the release position such that the hanger engagement is removable from the outer hanger when the actuator moves from the actuated position to the unactuated position.

11. The method of claim 10, wherein the actuator comprises an actuator ring adjacent to the hanger engagement, the actuator ring being axially moveable between the unactuated position and the actuated position, the actuator ring having an actuation surface that cooperates with the hanger engagement to convert axial movement of the actuator ring to radial movement of the hanger engagement.

12. The method of claim 11, wherein the wellhead housing comprises threaded pins that extend radially outward from the wellhead bore, and wherein actuating the actuator ring comprises threading the threaded pins into engagement with the actuator ring, the threaded pins engaging an outer sloped surface of the actuator ring to cause the actuator ring to shift axially toward the actuated position.

13. The method of claim 10, wherein the hanger engagement is actuated to the engagement position to secure the inner hanger within the outer hanger prior to inserting the outer hanger into the wellhead bore of the wellhead housing.

14. The method of claim 13, The method of claim 13, wherein the actuator comprises an actuator ring, wherein the inner hanger is secured within the outer hanger by locking the actuator ring in the actuated position.

15. The method of claim 14, wherein the actuator ring is locked in the actuated position by inserting pin connectors through apertures in the actuator ring.

16. The method of claim 10, wherein the hanger engagement comprises locking ring segments carried on the inner surface of the outer hanger and energizing pins that extend from an outer surface of the outer hanger, the energizing pins being engaged by the actuator, and wherein actuating the hanger engagement comprises applying a force to the energizing pins.

17. The method of claim 10, further comprising steps of:

removing the outer hanger and the inner hanger from the wellhead housing; and removing the support shoulder of the wellhead housing.

* * * * *